US010261429B2

(12) United States Patent
Asaka et al.

(10) Patent No.: US 10,261,429 B2
(45) Date of Patent: Apr. 16, 2019

(54) ELECTROPHOTOGRAPHIC MEMBER, METHOD FOR MANUFACTURING ELECTROPHOTOGRAPHIC MEMBER, AND FIXING APPARATUS

(71) Applicant: CANON KABUSHIKI KAISHA, Tokyo (JP)

(72) Inventors: Akeshi Asaka, Kahiwa (JP); Shigeaki Takada, Abiko (JP); Akiyoshi Shinagawa, Kasukabe (JP); Koichi Kakubari, Kashiwa (JP); Hiroto Ito, Tokyo (JP); Yutaka Arai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/861,772

(22) Filed: Jan. 4, 2018

(65) Prior Publication Data

US 2018/0210354 A1 Jul. 26, 2018

(30) Foreign Application Priority Data

Jan. 24, 2017 (JP) ..... 2017-010531

(51) Int. Cl.
*G03G 5/043* (2006.01)
*G03G 15/20* (2006.01)

(52) U.S. Cl.
CPC ..... *G03G 5/0433* (2013.01); *G03G 15/206* (2013.01); *G03G 15/2064* (2013.01)

(58) Field of Classification Search
CPC ..... G03G 5/0433; G03G 15/2064; G03G 15/2089; G03G 15/206; G03G 2215/2003; G03G 2215/2009
See application file for complete search history.

(56) References Cited

U.S. PATENT DOCUMENTS

| | | | | |
|---|---|---|---|---|
| 8,688,023 | B2 * | 4/2014 | Sekihara | G03G 15/206 399/333 |
| 2010/0196065 | A1 * | 8/2010 | Matsuki | G03G 15/2064 399/329 |
| 2011/0190410 | A1 | 8/2011 | Nozoe et al. | |
| 2012/0020709 | A1 * | 1/2012 | Uchiyama | G03G 15/2057 399/333 |
| 2012/0269560 | A1 * | 10/2012 | Sakakibara | G03G 15/2057 399/335 |
| 2014/0356040 | A1 | 12/2014 | Sakakibara et al. | |

(Continued)

FOREIGN PATENT DOCUMENTS

| | | | |
|---|---|---|---|
| JP | H07-129008 | A | 5/1995 |
| JP | 2000-187370 | A | 7/2000 |

(Continued)

*Primary Examiner* — Sandra Brase
(74) *Attorney, Agent, or Firm* — Venable LLP

(57) ABSTRACT

Provided is an electrophotographic member capable of reducing a rise time of a fixing apparatus and preventing occurrence of a defective image due to an electrostatic offset. The electrophotographic member has a substrate, an elastic layer, and a surface layer containing a fluororesin, in this order, the elastic layer has a communication hole of which pores are communicated with each other, and an ionic conductive agent is adhered to an inner wall of the communication hole.

10 Claims, 2 Drawing Sheets

(56) References Cited

U.S. PATENT DOCUMENTS

| | | | | |
|---|---|---|---|---|
| 2016/0018771 | A1* | 1/2016 | Arai | H05K 999/99<br>399/333 |
| 2017/0075253 | A1* | 3/2017 | Ito | C08G 18/4837 |
| 2017/0097594 | A1* | 4/2017 | Ishikawa | G03G 15/206 |

FOREIGN PATENT DOCUMENTS

| | | | |
|---|---|---|---|
| JP | 2001-265147 | A | 9/2001 |
| JP | 2002-339949 | A | 11/2002 |
| JP | 2008-150552 | A | 7/2008 |
| JP | 2010-134213 | A | 6/2010 |
| JP | 5577250 | B2 | 8/2014 |
| JP | 2015-007773 | A | 1/2015 |

* cited by examiner

ELECTROPHOTOGRAPHIC MEMBER, METHOD FOR MANUFACTURING ELECTROPHOTOGRAPHIC MEMBER, AND FIXING APPARATUS

BACKGROUND OF THE INVENTION

Field of the Invention

The present invention relates to an electrophotographic member which is capable of being used as a nip portion forming member and the like of a fixing apparatus which is installed in an image forming apparatus such as a copying machine, a printer, and a facsimile machine as well as a fixing apparatus that uses the electrophotographic member as a nip portion forming member.

Description of the Related Art

An image forming apparatus which employs an electrophotographic system and the like has a fixing apparatus which fixes a toner image on a recording material such as paper by heating and pressurizing the toner image developed on the recording material. In the fixing apparatus, a fixing nip part is formed by pressure-contacting of a fixing member such as a fixing belt and a fixing roller heated by a heat source, and a nip portion forming member such as a pressure roller arranged in a pair with the fixing member. Then, an unfixed toner is heated and pressurized to be fixed as a fixed image on a recording material when the recording material on which the unfixed toner image is formed is passed through the fixing nip part.

In recent years, it has been required to shorten a warm-up time and to save energy. Accordingly, it has been required to shorten a "rise time" that is required for a fixing member to achieve a predetermined temperature sufficient for a toner image to undergo heat fixing as well as to reduce electric energy consumption. In order to shorten the "rise time", a heat capacity and a thermal conductivity of a nip portion forming member such as a pressure roller have been reduced. For example, the above-described shortening of a rise time has been performed by making an elastic layer of a pressure roller be a porous elastic layer having lots of pores such that an amount of heat conducted from a fixing belt, which is heated following the operation start of a fixing apparatus, to the pressure roller is reduced (Japanese Patent Application Laid-open No. 2008-150552 and Japanese Patent Application Laid-open No. 2001-265147).

On the other hand, with regard to a pressure roller, an elastic layer is mainly composed of a silicone rubber, and a surface layer is mainly composed of an insulating polymer material such as a fluororesin. Accordingly, the surface of the pressure roller tends to be charged due to friction between the pressure roller and a fixing belt which forms a fixing nip part in a pair with the pressure roller and friction between the pressure roller and a recording material. As a result, a so-called electrostatic offset image, which makes a toner on the recording material scatter electrostatically, tends to occur. In order to suppress occurrence of the electrostatic offset image, it has been proposed to give electrical conductivity to the elastic layer and/or the surface layer of the pressure roller (Japanese Patent Application Laid-open No. H07-129008). In addition, when electrical conductivity is given to the surface layer of the pressure roller, releasability tends to be impaired, and therefore, a filler and the like in the recording material such as paper powder and talc tend to accumulate. As a result, on portions where the filler and the like accumulate, a toner tends to adhere, which soils the surface of the pressure roller, and there have been some cases where a defect in an image is generated. In order to suppress the generation of such a defect, a gloss value of a fluororesin tube which is compounded with an electrically conductive substance has been defined in Japanese Patent Application Laid-open No. 2010-134213.

Further, Japanese Patent No. 5577250 discloses a silicone sponge containing fine and uniform open cells as well as a material for an elastic layer of a fixing member of an image forming apparatus. Japanese Patent No. 5577250 proposes a three-component type sponge-forming liquid silicone rubber composition containing a mixture of water and an inorganic thickener in order to obtain fine and uniform open cells.

The present inventors, in a pressure roller which has a porous elastic layer containing fine and uniform open cells, have tried to give electrical conductivity to the porous elastic layer. First, when an electrical conductor agent such as carbon black has been added to a liquid silicone rubber, it has been found that an electrically conductive path is hardly formed since the porous elastic layer contains open cells, and that a large amount of an electrically conductive agent is required to achieve desired electrical conductivity. In addition, when a large amount of the electrically conductive agent has been added, there have been some cases where fineness and uniformity of cells have been insufficient due to reduction in an action of an emulsifier.

SUMMARY OF THE INVENTION

One embodiment of the present invention is directed to provide an electrophotographic member capable of reducing a rise time of a fixing member and preventing occurrence of a defective image due to an electrostatic offset. In addition, another embodiment of the present invention is directed to provide a fixing apparatus capable of forming a high-quality electrophotographic image stably.

According to one embodiment of the present invention, there is provided an electrophotographic member including a substrate, an elastic layer, and a surface layer containing a fluororesin, in this order, wherein the elastic layer has a communication hole of which pores are communicated with each other, and an ionic conductive agent is adhered to an inner wall of the communication hole.

In addition, according to another embodiment of the present invention, there is provided a method for manufacturing an electrophotographic member which includes: arranging a fluororesin layer at an outer periphery of a substrate separately from the substrate and injecting a liquid silicone rubber composition into a space between the substrate and the fluororesin layer, the liquid silicone rubber composition containing a liquid silicone rubber into which water, in which an ionic conductive agent is dissolved, is emulsified and dispersed; primarily curing the liquid silicone rubber composition to form a silicone rubber layer in a water-containing state; and removing water from the silicone rubber layer in the water-containing state to form an elastic layer having a communication hole of which pores are communicated with each other.

In addition, according to another embodiment of the present invention, there is provided a fixing apparatus including a fixing member, and a nip portion forming member that fixes an unfixed toner image as a fixed image on a recording material by causing elastic deformation by being pressure-contacted with the fixing member to form a fixing nip part that sandwiches, conveys and heats the recording material on which the unfixed toner image is formed, wherein the nip portion forming member is the above described electrophotographic member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[Electrophotographic Member]

The electrophotographic member according to one embodiment of the present invention has a substrate, an elastic layer, and a surface layer containing a fluororesin, in that order. The elastic layer has a communication hole of which pores are communicated with each other, and an ionic conductive agent is adhered to an inner wall of the communication hole.

Hereinafter, the electrophotographic member according to one embodiment of the present invention is described by referring to a pressure member (a pressure roller) which is used as a nip portion forming member of a fixing apparatus. However, the electrophotographic member is not limited thereto.

[Pressure Roller]

Figure 1:
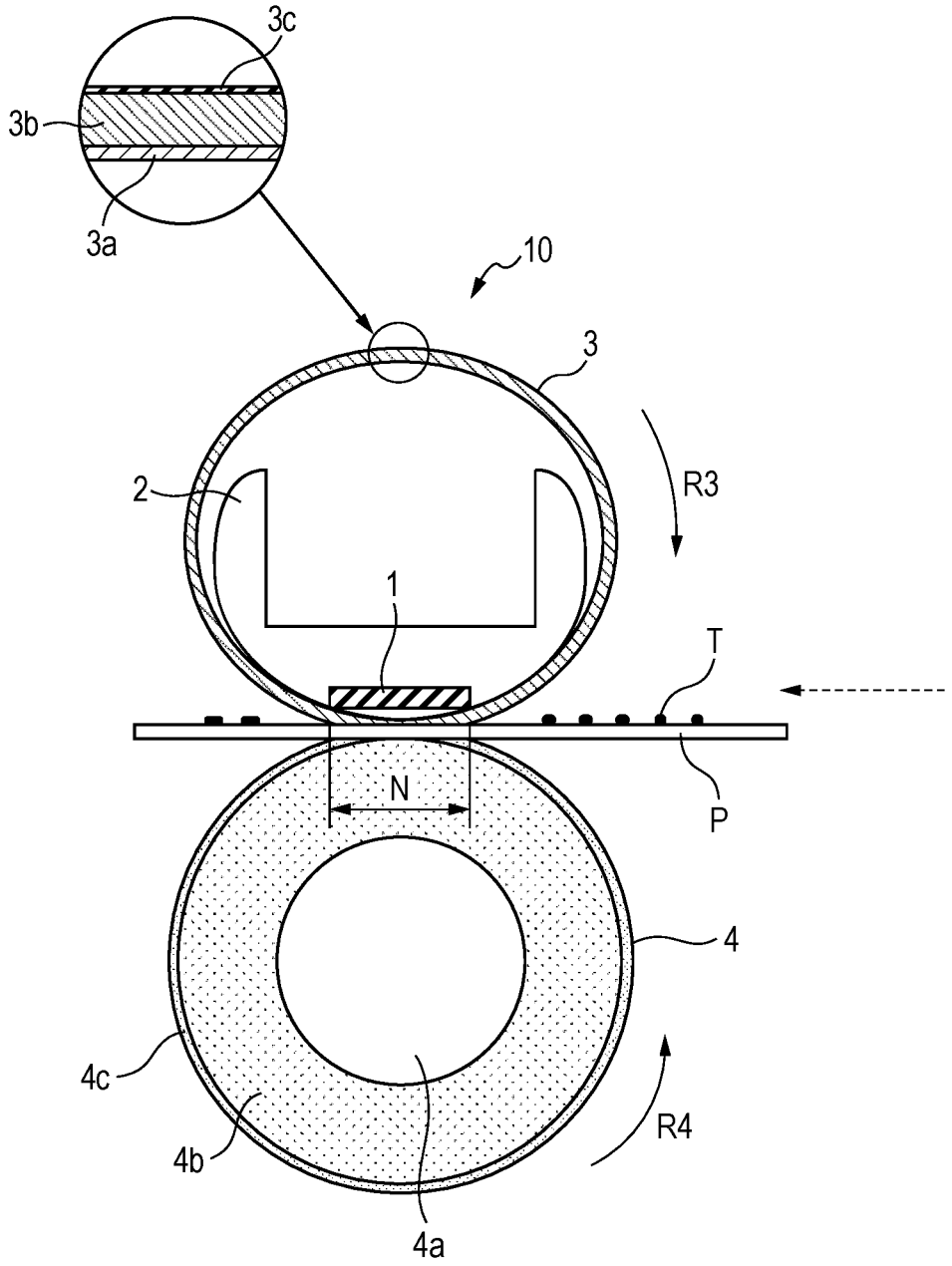
FIG. 1 is a cross-sectional schematic diagram which shows one example of the constitution of the fixing apparatus according to one embodiment of the present invention.

FIG. 1 is a cross-sectional schematic diagram which shows one example of the constitution of the fixing apparatus according to one embodiment of the present invention. The fixing apparatus has a pressure roller 4 as a nip portion forming member. The pressure roller 4 is formed as a multilayer structure which has a substrate 4*a*, an elastic layer 4*b* at the outer periphery of the substrate 4*a*, and a release layer 4*c* as a surface layer.

<Substrate>

The substrate of the pressure roller is a shaft core or a mandrel formed by using a stainless steel including a steel material such as nickel-plated and chromium-plated SUM materials (sulfur and sulfur-composite free-cutting steel materials), phosphor bronze, aluminum and the like. An outside diameter of the substrate may be from 4 mm to 80 mm.

<Elastic Layer>

The elastic layer of the pressure roller is a layer which covers the outer periphery of the substrate. The elastic layer of the pressure roller functions as a layer which gives the pressure roller elasticity capable of forming a fixing nip by pressure contacting with an opposed member (a fixing belt). In order for the elastic layer to exhibit such a function, it is preferable to use a silicone rubber as a base rubber material of the elastic layer from the point of view of heat resistance. In particular, it is preferable to use a liquid silicone rubber such as an addition reaction crosslinking type silicone rubber. In general, the addition reaction crosslinking type silicone rubber contains an organopolysiloxane having an unsaturated aliphatic group, an organohydrogenpolysiloxane having a hydrogen atom bound to a silicon atom, and a platinum compound as a hydrosilylation catalyst. The organopolysiloxane is a base polymer of the liquid silicone rubber, and it is preferable to use the organopolysiloxane having a number average molecular weight of 5,000 to 100,000, and a weight average molecular weight of 10,000 to 500,000. The liquid silicone rubber is a polymer having flowability at room temperature, and is cured by heating. After being cured, the liquid silicone rubber has low hardness appropriately, and has sufficient heat resistance and deformation restoring force.

A thickness of the elastic layer is not particularly limited as long as the thickness of the elastic layer is capable of causing to form a fixing nip part with a desired width when the elastic layer as a whole contacts with the fixing belt and undergoes elastic deformation. It is preferable that the thickness of the elastic layer is from 1.5 to 10.0 mm. It is preferable that a hardness of the elastic layer is equal to or more than 20° and equal to or less than 70° from the point of view of securing a fixing nip part N with a desired width. Meanwhile, a hardness is the hardness measured by using an ASKER-C durometer.

Figure 2:
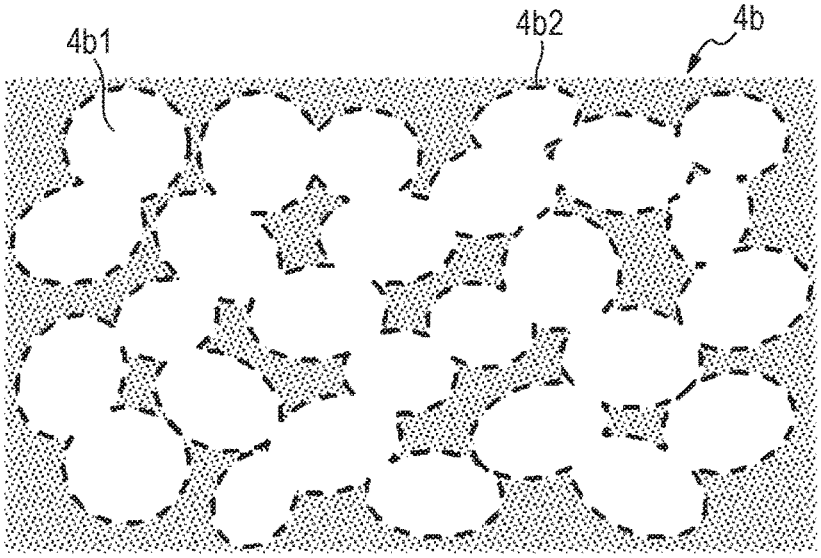
FIG. 2 is a schematic diagram which shows one example of the cross section of the elastic layer of the electrophotographic member according to one embodiment of the present invention.

The elastic layer has a communication hole of which pores are communicated with each other. For example, as shown in FIG. 2, a communication hole 4*b*1 of which pores are communicated with each other is formed. It is preferable that an average diameter of each of the pores is equal to or more than 5 μm and equal to or less than 30 μm from the points of view of strength of the elastic layer and image quality of the electrophotographic image. A heat capacity of the elastic layer is reduced by having such a communication hole. In addition, a thermal conductivity of the elastic layer is lower than a thermal conductivity of an elastic layer having no communication hole.

In addition, a specific gravity of the elastic layer is lowered by having the communication hole. It is desirable that the specific gravity of the elastic layer is in the range from 0.5 to 0.6 in order to exhibit a sufficient effect for reducing a rise time of the fixing apparatus.

It is suitable that a rate of volume occupation (hereinafter, also referred to as "a void rate") of the communication hole in the elastic layer is equal to or more than 40 volume % and equal to or less than 50 volume %. When the void rate is equal to or more than 40 volume %, it is easy to achieve an effect for reducing a rise time expected for the fixing apparatus. When the void rate is equal to or less than 50 volume %, the elastic layer becomes a layer containing fine pores uniformly. When the void rate is in the above-described range, it is possible to maintain a state where water is dispersed in a liquid silicone rubber composition described later uniformly and finely in a process of forming the elastic layer. Meanwhile, a method for measuring an average diameter of pores is described later.

In the present invention, an ionic conductive agent is used in order to give electrical conductivity to the elastic layer. In the present invention, as shown in a manufacturing method described later, the ionic conductive agent is used by being dissolved in water, and therefore, a water-soluble ionic conductive agent is used. Suitable examples of the water-soluble ionic conductive agent include a potassium salt type ionic conductive agent and a lithium salt type ionic conductive agent. In addition, it is desirable that the ionic conductive agent is capable of existing stably even after being subjected to the highest heating temperature (for example, about 200° C.) of the silicone rubber used as the elastic layer.

Accordingly, it is preferable that the ionic conductive agent has a heat resistance (a decomposition temperature) of equal to or higher than 200° C.

Examples of the potassium salt type ionic conductive agent include potassium trifluoromethanesulfonate ($CF_3SO_3K$), potassium bis(trifluoromethanesulfonyl)imide ($(CF_3SO_2)_2NK$) and the like. In addition, examples of the lithium salt type ionic conductive agent include lithium trifluoromethanesulfonate ($CF_3SO_3Li$), lithium nonafluorobutanesulfonate ($C_4F_9SO_3Li$), lithium bis(trifluoromethanesulfonyl)imide ($(CF_3SO_2)_2NLi$) and the like.

A content of the ionic conductive agent is not particularly limited as long as desired electrical conductivity can be given to the elastic layer. It is preferable that the content of the ionic conductive agent is 3 to 10 parts by mass as a feeding amount based on 100 parts by mass of the liquid silicone rubber that is a raw material for forming the elastic layer.

<Surface Layer>

In the electrophotographic member according to the present invention, the surface layer is a layer composed of an insulating fluororesin. The surface layer is formed by covering the outer periphery of the elastic layer, for example, with a tetrafluoroethylene-perfluoroalkyl vinyl ether copolymer (PFA) tube. Alternatively, the surface layer may be formed by applying a coating material composed of a fluororesin such as a PFA, a polytetrafluoroethylene (PTFE), and a tetrafluoroethylene-hexafluoropropylene (FEP) on the outer periphery of the elastic layer. A thickness of the surface layer is not particularly limited. It is preferable that the thickness of the surface layer is about 15 to 80 μm. The surface layer is provided in order to make adhesion of a toner to the pressure roller hard to be caused. It is desirable that the surface layer is used in a state of a pure fluororesin which contains no additives such as an electrically conductive agent from the points of view of releasability of the toner, flexibility, mechanical strength, and durability.

Meanwhile, a primer layer, an adhesion layer or the like may be provided between the elastic layer and the surface layer for the purpose of adhesion, electrical conduction and the like.

[Manufacturing Method of Electrophotographic Member]

The method for manufacturing the electrophotographic member according to one embodiment of the present invention has:

arranging a fluororesin layer at an outer periphery of a substrate separately from the substrate and injecting a liquid silicone rubber composition into a space between the substrate and the fluororesin layer, wherein the liquid silicone rubber composition contains a liquid silicone rubber into which water, in which an ionic conductive agent is dissolved, is emulsified and dispersed;

primarily curing the liquid silicone rubber composition to form a silicone rubber layer in a water-containing state; and removing water from the silicone rubber layer in the water-containing state to form an elastic layer having a communication hole of which pores, for example, those having an average diameter of equal to or more than 5 μm and equal to or less than 30 μm, are communicated with each other.

Hereinafter, the method for manufacturing the electrophotographic member according to one embodiment of the present invention is described specifically.

[Method for Forming Communication Hole]

One example of a method for forming the communication hole in the elastic layer is a method which includes using the liquid silicone rubber which is a base polymer and water which is present in a dispersed state in the base polymer, in a manufacturing process of a pressure member described later. Water is removed in the manufacturing process, and the communication hole is formed in the elastic layer after the removal of water. Water is not dispersed in the liquid silicone rubber by itself, and therefore, is used in a state where a water-absorbing polymer, a clay mineral or the like, which does not affect the characteristics of the elastic layer after the removal of water, swells with water. In other words, water is used in the form of "a water-containing gel". In addition, in the present invention, a water-soluble ionic conductive agent is added to water, and thereafter, the water-absorbing polymer, the clay mineral or the like which is caused to swell with water, that is, "the water-containing gel" is used. An emulsifier, and as needed, a viscosity modifier are added to the water-containing gel which contains the ionic conductive agent and the liquid silicone rubber, and then they are mixed and stirred to prepare the liquid silicone rubber composition in an emulsion state for forming the elastic layer. The liquid silicone rubber composition is injected into a cast molding die, and the liquid silicone rubber composition is cured at a temperature below the boiling point of water to form an elastic body in which water in the liquid silicone rubber composition is dispersed uniformly and finely. After that, water is caused to evaporate (to be removed) from the elastic body to form the elastic layer in which fine pores are formed uniformly. At the same time, the ionic conductive agent is caused to adhere to the inner walls of the pores to give electrical conductivity to the elastic layer.

Examples of the water-absorbing polymer include acrylic acid, methacrylic acid, a polymer of a metal salt thereof, a copolymer and a crosslinked body thereof and the like. Among them, an alkali metal salt of a polyacrylic acid, a crosslinked body thereof and the like may be suitably used and are industrially available (for example, "Rheogic 250H" (trade name, manufactured by TOAGOSEI CO., LTD.)). In addition, the use of "water with which the clay mineral having a thickening effect swells" is suitable for preparing the liquid silicone rubber composition for forming the elastic layer in an emulsion state. Examples of the clay mineral include "Bengel W-200U" (trade name, manufactured by HOJUN Co., Ltd.) and the like. Further, as the emulsifier, a surfactant such as a nonionic surfactant (a sorbitan fatty acid ester, trade name, "Ionet HLB 4.3", manufactured by Sanyo Chemical Industries, Ltd.) may be added.

[Preparation of Liquid Silicone Rubber Composition]

The liquid silicone rubber composition may be prepared by mixing the water-containing gel which contains the water-absorbing polymer which is made to contain water in which the ionic conductive agent is dissolved beforehand, and the liquid silicone rubber which is compounded with the emulsifier. When the liquid silicone rubber composition is prepared, a predetermined amount of each of the liquid silicone rubber and the water-containing gel is weighed, and the liquid silicone rubber and the water-containing gel may be stirred by using a known mixing and stirring unit such as a planetary universal mixing and stirring device (a planetary mixer or a planetary disper). Other ingredients such as a curing retarder may be added to the liquid silicone rubber composition as long as curing of the present invention is not impaired. With regard to compounded amounts of other ingredients and each of ingredients, reference can be made to the description of Japanese Patent No. 5577250 except for the ionic conductive agent.

[Formation of Elastic Layer]

A method for forming the elastic layer is not particularly limited, and a molding method which uses a die is described as an example. Before forming the elastic layer, the substrate is subjected to primer treatment beforehand. On the other hand, as a material for the surface layer, a fluororesin tube of which the inner surface has been subjected to etching treatment is used. The fluororesin tube is equipped beforehand such that the fluororesin tube is positioned along an inner wall surface of a cylindrical die. The substrate is inserted into the cylindrical die, and the substrate is arranged concentrically within the cylindrical die by inserting a die mold having an inlet port into one end part and by inserting a die mold having an outlet port into the other end part such that die molds hold the substrate, and pressing the cylindrical die and the die molds at both end parts by jigs. Then, the liquid silicone rubber composition for forming the elastic layer is injected into a gap between the substrate and the fluororesin tube within the cylindrical die such that the liquid silicone rubber composition flows along the axial direction of the arranged substrate. After filling the die with the liquid silicone rubber composition, the die is sealed and is heated. The liquid silicone rubber composition is, together with the die, subjected to heat treatment at a temperature below the boiling point of water, for example, at 60° C. to 90° C. for 5 minutes to 120 minutes. When the liquid silicone rubber composition is subjected to the heat treatment in a sealed state, a silicone rubber component is crosslinked and cured (primarily cured) in a state where moisture in the water-containing gel is held. In this manner, the silicone rubber layer in the water-containing state is formed.

[Formation of Communication Hole]

After the silicone rubber component is cured, the die is opened by removing die molds from both end parts of the die, and then the roller is further heated together with the die. Since moisture contained in the water-containing gel evaporates as the temperature in the elastic layer is elevated by heating, the communication hole in which pores are communicated with each other is formed in the position. It is desirable that the heating temperature is set to a temperature above the boiling point of water, for example, 100° C. to 180° C., and that the heating time is set to 1 to 5 hours. By this heat treatment, crosslinking of the silicone rubber further proceeds (the silicone rubber is secondarily cured). The ionic conductive agent which has been dissolved in water remains in a state of adhering to the inner wall of the communication hole. As described above, the elastic layer having the communication hole is formed on the outer peripheral surface of the substrate and on the inner peripheral surface of the surface layer.

[Removal of Roller from Die]

After the heated die is cooled by a water cooling system or by an air cooling system, the roller is removed from the die. In this manner, the electrophotographic member (the pressure roller) is obtained. After the removal from the die, crosslinking may be further caused to proceed by conducting heat treatment at about 200° C.

[Electrophotographic Image Forming Apparatus]

Figure 3:
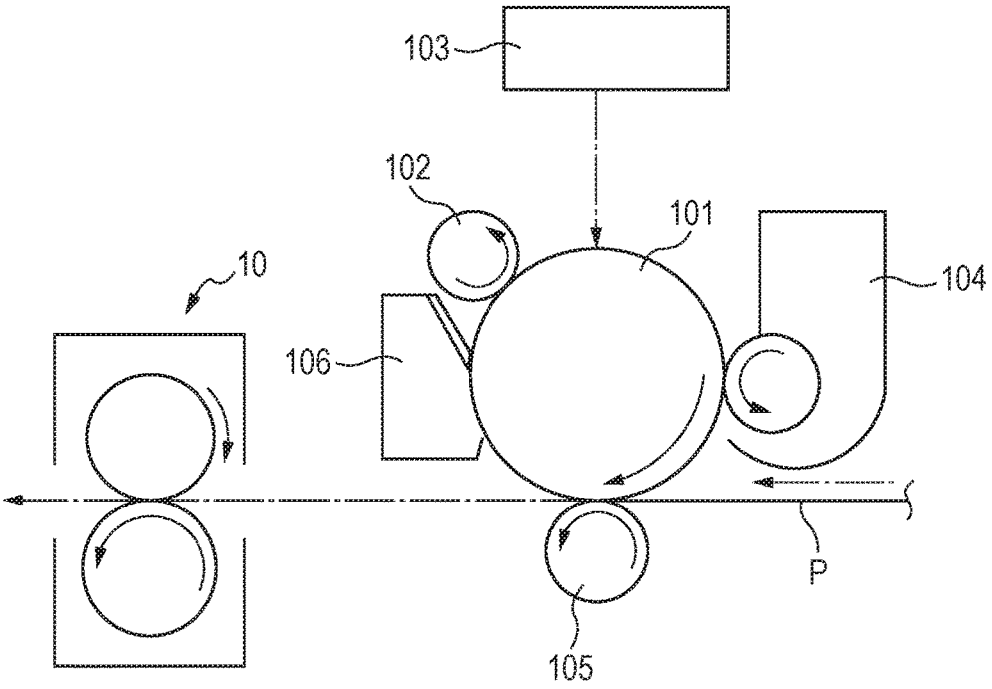
FIG. 3 is a schematic block diagram of one example of an electrophotographic image forming apparatus.

Examples of an electrophotographic image forming apparatus for which the electrophotographic member according to the present invention and the fixing apparatus according to the present invention are used include an apparatus as shown in FIG. 3. The apparatus has: an electrophotographic photosensitive member 101 which rotates; a charging unit 102 and an image exposure unit 103, each of which acts as a latent image forming unit; and a developing unit 104 which develops a latent image formed on the electrophotographic photosensitive member with a toner. In addition, the apparatus also has: a transfer unit 105 which transfers a developed toner image onto a recording material P; a cleaning unit 106 which cleans the surface of the electrophotographic photosensitive member after the transfer of the toner image; a fixing apparatus 10 as a fixing unit which fixes the toner image on the recording material; and the like.

[Fixing Apparatus]

The fixing apparatus according to the present invention has a fixing member, and a nip portion forming member. The nip portion forming member fixes an unfixed toner image as a fixed image on the recording material by causing elastic deformation by pressure-contacting with the fixing member to form the fixing nip part which sandwiches, conveys and heats the recording material on which the unfixed toner image is formed. As the nip portion forming member, the electrophotographic member according to the present invention is used.

FIG. 1 is a cross-sectional schematic diagram which shows one example of the constitution of the fixing apparatus according to one embodiment of the present invention. The fixing apparatus 10 shown in FIG. 1 has a ceramics heater (hereinafter referred to simply as "the heater") 1 which acts as a heating body, a heater holder 2 which acts as a heating body supporting member, a fixing belt 3 which acts as the fixing member, and the pressure roller 4 which acts as the nip portion forming member.

[Heater]

The heater 1 has a heat source, for example, a heating resistor or the like, which generates heat by being energized by an electricity supplying unit not illustrated in the drawings. The temperature of the heater 1 rises quickly by being supplied with electricity. The temperature of the heater 1 is detected by a temperature detection unit not illustrated in the drawings, and the detected temperature information is input to a control unit not illustrated in the drawings. The control unit controls the temperature of the heater 1 to be a predetermined temperature by controlling electricity supplied from the electricity supplying unit to the heat source such that the detected temperature input from the temperature detection unit is maintained to be a predetermined fixing temperature.

The heater 1 is fixed and supported by the heater holder (hereinafter referred to simply as "the holder") 2 which is formed in a bucket shape whose cross section is an approximately semicircular shape, and is formed of a heat resistance material having rigidity. Specifically, a groove is provided on the lower surface of the holder 2 along the longitudinal direction of the holder (in the direction of the front and rear sides of paper in FIG. 1), and the heater 1 is inserted in the groove.

The fixing belt 3 as the fixing member has, from the inside to the outside, an annular base material 3*a*, a belt elastic layer 3*b* (here, referred to as "the belt elastic layer" in order to be distinguished from the elastic layer 4*b* of the pressure roller 4 described later), and a surface layer 3*c*. The fixing belt 3 is an endless belt of which the inner peripheral surface is rubbed with the heater and the holder in an operating state. The fixing belt 3 is externally fitted on the outer periphery of the holder 2 which supports the heater with a margin of the length of the perimeter.

As described later, the heater and the pressure roller are pressure-contacted with the fixing belt being sandwiched between them, and the fixing nip part N is formed between the fixing belt and the pressure roller. When a rotation driving apparatus, for example, a motor or the like, rotates the pressure roller at a predetermined peripheral speed in a counterclockwise direction, shown by an arrow R4, the fixing belt rotates outside the holder in a clockwise direction, shown by an arrow R3, driven by the rotation of the pressure roller while the inner surface of the fixing belt contacts with the surface of the heater and slides.

[Holder]

The holder 2 functions as a holding member of the heater 1. At the same time, the holder 2 also functions as a rotation guiding member of the fixing belt 3. A lubricant (grease) is applied on the inner peripheral surface of the fixing belt to secure sliding of the fixing belt along the heater and the holder. Meanwhile, in the present specification, a belt is the term which includes a film shaped belt.

[Pressure Roller]

The pressure roller 4, from the inside to the outside, has the substrate (the mandrel) 4*a*, the elastic layer (the rubber layer) 4*b*, and the release layer 4*c* as the surface layer. The pressure roller 4 is caused to rotate by the rotation driving apparatus not illustrated in the drawings when being used. Accordingly, the substrate 4*a* is supported rotatably by an immobile part such as a frame of the fixing apparatus 10 not illustrated in the drawings via a bearing member.

The pressure roller is arranged at a position opposing to the heater supported by the holder while sandwiching the fixing belt. Then, when a predetermined pressure is applied to the pressure roller and the fixing belt by a pressurizing mechanism not illustrated in the drawings, the pressure roller and the fixing belt are pressure-contacted with each other, and then the elastic layer (3*b*, 4*b*) of each of them is elastically deformed. In this manner, the fixing nip part N, which has a predetermined width with respect to the conveying direction of the recording material (the paper conveying direction), is formed between the pressure roller and the fixing belt.

When the pressure roller is rotated by the rotation driving apparatus, at the fixing nip part N, which is formed between the pressure roller and the fixing belt which is driven to rotate, the pressure roller and the fixing belt sandwich and convey paper (the recording material) P. In addition, the fixing belt is heated by the heater such that the temperature of the surface of the fixing belt reaches a predetermined temperature (for example, 200° C.) In such a state, when paper on which the unfixed toner image is formed with an unfixed toner T is sandwiched and conveyed to the fixing nip part N, the unfixed toner on paper is heated and pressurized. As a result, the unfixed toner is melted and colors are mixed. Accordingly, thereafter, the unfixed toner image is fixed as the fixed image on paper by cooling the unfixed toner image.

[Fixing Belt]

The fixing belt 3 as the fixing member is provided with the belt elastic layer 3*b* at the outer periphery of the base material 3*a*, as shown in FIG. 1. The fixing belt 3 is also provided with a release layer 3*c* as the surface layer at the outer periphery of the belt elastic layer 3*b*. As a material of the base material, a heat resistant resin, for example, a polyimide, a polyamide imide, a polyether ether ketone (PEEK) or the like is used in view of necessity of heat resistance and flex resistance. In addition, when thermal conductivity is also considered, a metal such as a stainless steel (SUS), nickel and a nickel-plated alloy which has a higher thermal conductivity than the heat resistant resin may be used as the material of the base material. In addition, it is required that the base material has a smaller heat capacity and a higher mechanical strength, and therefore, a thickness of the base material is preferably 5 μm to 100 μm, and is more preferably 20 μm to 85 μm.

The belt elastic layer is a layer which covers the outer periphery of the base material. When the recording material passes through the fixing nip part N, the belt elastic layer uniformly gives heat to the unfixed toner in such a manner as to wrap the unfixed toner on the recording material. Since the belt elastic layer functions in such a manner, a high quality image with high gloss and without fixing unevenness can be obtained. However, when a thickness of the belt elastic layer is too low, sufficient elasticity tends to be hard to be obtained, and a high quality image tends to be hard to be obtained. On the contrary, when the thickness of the belt elastic layer is too high, a heat capacity tends to be large, and therefore, it takes a long time to reach a predetermined temperature by heating. Accordingly, the thickness of the belt elastic layer is preferably 30 μm to 500 μm, and is more preferably 100 μm to 300 μm.

A material for the belt elastic layer is not particularly limited, and it is preferable to use an addition reaction crosslinking type liquid silicone rubber because of easy processability, high-dimensional accuracy when being processed, no occurrence of reaction by-products when being heated and cured, and other reasons. Examples of the addition reaction crosslinking type liquid silicone rubber used for the belt elastic layer include the same materials as those exemplified as the materials for the elastic layer of the nip portion forming member.

By the way, when the belt elastic layer is formed of a silicone rubber alone, a thermal conductivity of the belt elastic layer tends to be low. When the thermal conductivity of the belt elastic layer is low, heat generated by the heater is hardly conducted to the recording material through the fixing belt, and therefore, heating becomes insufficient when the toner is fixed on the recording material. As a result, a defective image having fixing unevenness or the like may be produced. Then, in order to raise the thermal conductivity of the belt elastic layer, it is preferable that a filler having high thermal conductivity, for example, a granular filler having high thermal conductivity is mixed and dispersed in the belt elastic layer.

Examples of the granular filler having high thermal conductivity which may be used include silicon carbide (SiC), zinc oxide (ZnO), alumina ($Al_2O_3$), aluminum nitride (AlN), magnesium oxide (MgO), carbon and the like. Examples of the shape of the filler having high thermal conductivity include a granular shape, a needle shape, a crushed shape, a plate shape, a whisker-like shape and the like. For the belt elastic layer, the filler having any of these shapes may be used. In addition, one kind of the filler may be used alone and two or more kinds of the fillers may be used in combination. Meanwhile, when the filler having high thermal conductivity is electrically conductive, the belt elastic layer is caused to be electrically conductive by adding the filler having high thermal conductivity to the belt elastic layer.

[Release Layer]

The release layer is a fluororesin layer which covers the outer periphery of the belt elastic layer. The release layer is provided in order to prevent the toner from adhering to the fixing belt. Examples of the material of the release layer which can be used include a fluororesin such as a PFA, a PTFE and an FEP. A thickness of the release layer is preferably 1 μm to 50 μm, and is more preferably 8 μm to 25 μm. The release layer can be formed at the outer periphery of the belt elastic layer by covering the belt elastic layer with a fluororesin tube or applying a coating material composed of a fluororesin. A primer layer, an adhesion layer and the like may be provided between the belt elastic layer and the release layer for the purpose of adhesion, electrical conduction and the like.

According to one embodiment of the present invention, an electrophotographic member, which is capable of reducing a rise time of a fixing apparatus and is capable of preventing occurrence of a defective image due to an electrostatic offset, can be obtained. In addition, according to another embodiment of the present invention, a fixing apparatus, which is capable of forming a high-quality electrophotographic image stably, can be obtained.

EXAMPLES

The present invention is specifically described hereinbelow by referring to Examples and Comparative Examples. Before the description of Examples, evaluation methods are described.

<Evaluation 1> Measurement of Pore Diameter

An elastic layer is cut by a razor or the like to give a sample piece 1 having a length of 2.5 mm, a width of 2.5 mm, and a thickness of 2.5 mm. The cut surface is observed with a scanning electron microscope (for example, trade name: S-4700, manufactured by Hitachi High-Technologies Corporation, a magnification of 300). Then, a predetermined area (having a length of 300 μm and a width of 300 μm) is binarized, and the longest diameter Dmax and the shortest diameter Dmin of each of pores are measured. A value obtained by dividing the sum of the longest diameter and the shortest diameter by 2 is defined as a pore diameter of each of pores. An average value of all the measured pore diameters is obtained, and the average value is defined as an average diameter of pores.

<Evaluation 2> Measurement of Specific Gravity

An elastic layer is cut by a razor or the like to give a sample piece 2 having a length of 20 mm, a width of 20 mm, and a thickness of 2.5 mm.

As a water replacement type density and specific gravity meter, an automatic specific gravity meter "DSG-1" (trade name, manufactured by Toyo Seiki Seisaku-sho, Ltd.) is used to measure a specific gravity of the sample piece 2.

<Evaluation 3> Image Evaluation

Image evaluation is performed by using an electrophotographic member as a pressure roller, an A3 type fixing apparatus of a film heating system as shown in FIG. 1, and an image forming apparatus (product name, "image RUNNER ADVANCE C5255", manufactured by Canon Inc.) equipped with the fixing apparatus.

Electrical conductivity of an elastic layer of the pressure roller can be confirmed by an electrostatic offset image accompanied with paper feeding. When the electrical conductivity is insufficient, the surface of the pressure roller is charged to the same polarity as a toner due to friction between a release layer (a surface layer) of the pressure roller and a fixing belt which is paired with the pressure roller or friction between paper and the surface of the pressure roller. As a result, an electrostatic offset image, which makes the toner on paper scatter electrostatically, is generated. On the other hand, when the electrical conductivity of the elastic layer of the pressure roller is sufficient, electrification of the release layer of the pressure roller due to friction is suppressed, and therefore, no electrostatic offset image is generated.

Evaluation of an electrostatic offset is performed as follows. Continuous printing on 200 sheets of LTR lateral size paper (Neenah Bond 60 g/m$^2$, manufactured by Neenah Paper Inc.) is performed to give a halftone image with a leading edge of 50 mm at a speed of 50 sheets per minute, under an environment of a low temperature (15° C.) and a low humidity (a relative humidity of 10%), by setting a total pressing force at the fixing apparatus to about 320 N (about 160 N at one end side), and setting a rotational speed (a peripheral speed) of the pressure roller to 246 mm/sec. Evaluation is performed based on the electrostatic offset image at that time. A result of evaluation is judged based on the following criteria.

A: Entirely no electrostatic offset image is generated.

B: Electrostatic offset image(s) is generated.

Example 1

1. Preparation of Liquid Silicone Rubber Composition

An addition reaction crosslinking type liquid silicone rubber "DY35-2083" (trade name, manufactured by Dow Corning Toray Co., Ltd.) compounded with a polyether-modified silicone (trade name: FZ-2233, manufactured by Dow Corning Toray Co., Ltd.) as an emulsifier was used. A water-containing gel was prepared by adding 99 mass % of ion exchanged water to 1 mass % of a thickening agent which contained a sodium polyacrylate as a main ingredient and also contained a smectite clay mineral, and stirring them sufficiently such that the thickening agent swelled with ion exchanged water. Meanwhile, "Bengel W-200U" (trade name, manufactured by HOJUN Co., Ltd.) was used as the thickening agent. In addition, ion exchanged water had been compounded with potassium trifluoromethanesulfonate beforehand as an ionic conductive agent such that 5 parts by mass of potassium trifluoromethanesulfonate and 100 parts by mass of the liquid silicone rubber were mixed.

One hundred parts by mass of the liquid silicone rubber and 100 parts by mass of the water-containing gel were mixed and stirred by using a planetary universal mixing and stirring device (trade name "Highvismix 2P-1 type", manufactured by PRIMIX Corporation) under a condition at 80 rpm for 60 minutes. In such a manner, water was made to be emulsified and dispersed into the liquid silicone rubber to give a liquid silicone rubber composition for forming an elastic layer.

2. Manufacture of Pressure Roller No. 1.

A mandrel made of iron for A3 size (having a length of a forming region for the elastic layer of 327 mm) was used as a substrate. As a primer, "DY39-051" (trade name, manufactured by Dow Corning Toray Co., Ltd.) was used. As a material for a surface release layer, a PFA (trade name: 451HP-J, manufactured by Du Pont-Mitsui Fluorochemicals Co., Ltd.) tube made of a fluororesin having an inside diameter of 29.0 mm was used.

The primer was applied on a peripheral surface of the mandrel, and thereafter, the mandrel was fired in a hot air circulating oven at a temperature of 180° C. for 30 minutes. On the other hand, the PFA tube was inserted into a hollow cylindrical die having an inside diameter of 30.2 mm, and both end parts of the tube were folded along an outer wall surface of the hollow cylindrical die such that the PFA tube was arranged on an inner wall surface of the cylindrical die. A primer "DY39-067" (trade name, manufactured by Dow Corning Toray Co., Ltd.) was applied on the inner surface of the PFA tube, and drying was performed in the hot air circulating oven at 70° C. for 20 minutes.

The mandrel after primer treatment was arranged concentrically within the hollow cylindrical die, and die molds were inserted into both the upper and lower end parts of the hollow cylindrical die. Then, the mandrel was fixed and arranged concentrically within the hollow cylindrical die by pressing the hollow cylindrical die and the die molds at both end parts by jigs.

Next, the above-described liquid silicone rubber composition was injected into a space between the fluororesin tube arranged on the inner wall of the die and the mandrel, and the die molds at both end parts of the die were sealed. After that, the liquid silicone rubber composition was left to stand together with the die in the hot air circulating oven at 90° C. for 1 hour such that the liquid silicone rubber composition was cured. In this manner, the mandrel, the silicone rubber and the fluororesin tube were integrated.

The die which had been heated was cooled to a temperature of equal to or lower than 50° C., and thereafter, the die molds at both end parts were removed from the die. The content in the die was left to stand in the hot air circulating oven at a temperature of 180° C. for 2 hours together with the die in a state where both end parts of the die were opened such that moisture in the elastic layer was made to evaporate. In this manner, a communication hole(s) was formed. The die was cooled to a temperature of equal to or lower than 50° C., and thereafter, a roller covered with the tube was removed from the die, and the roller was left to stand in the hot air circulating oven at 200° C. for 4 hours such that the silicone rubber in the elastic layer was secondarily cured.

A pressure roller No. 1 was obtained by passing through the above processes. An outside diameter at the central part in the longitudinal direction of the pressure roller No. 1 obtained by laminating the substrate, the elastic layer, and the surface layer (the release layer) was made to be 30 mm.

Comparative Example 1

A liquid silicone rubber composition was obtained in the same manner as Example 1 except that water was not compounded with any ionic conductive agent. Then, a pressure roller No. 6 was obtained. The evaluation result is shown in Table 1.

Comparative Example 2

To 100 parts by mass of an addition reaction crosslinking type liquid silicone rubber "DY35-2083" which had been compounded with a polyether-modified silicone (trade name: FZ-2233, manufactured by Dow Corning Toray Co., Ltd.) beforehand as an emulsifier, 5 parts by mass of carbon black was admixed as an electrically conductive agent. The thus obtained mixture and 100 parts by mass of a water-containing gel (containing no ionic conductive agent) which was similar to that used in Example 1 were mixed and stirred in the same procedure as Example 1 to give a liquid silicone rubber composition into which water was emulsified and dispersed. Then, a pressure roller No. 7 was obtained in the same manner as Example 1. The evaluation result is shown in Table 1.

Comparative Example 3

A liquid silicone rubber composition was obtained in the same manner as Comparative Example 2 except that the amount of carbon black was changed to 10 parts by mass. Then, a pressure roller No. 8 was obtained. The evaluation result is shown in Table 1.

TABLE 1

| | Liquid silicone rubber | Water-containing gel | Electrically conductive agent | | Average | Standard deviation | | |
|---|---|---|---|---|---|---|---|---|
| | [Parts by mass] | [Parts by mass] | Type | Parts by mass | diameter [μm] | of pore diameter | Specific gravity | Electrostatic offset |
| Example 1 | 100 | 100 | $CF_3SO_3K$ | 5 | 18 | 7.33 | 0.56 | A |
| Example 2 | 100 | 100 | $CF_3SO_3Li$ | 5 | 19 | 7.75 | 0.56 | A |
| Example 3 | 100 | 100 | $(CF_3SO_2)_2NK$ | 5 | 16 | 6.97 | 0.56 | A |
| Example 4 | 100 | 100 | $(CF_3SO_2)_2NLi$ | 5 | 15 | 6.77 | 0.56 | A |
| Example 5 | 100 | 100 | $C_4F_9SO_3Li$ | 5 | 15 | 6.80 | 0.56 | A |
| Comparative Example 1 | 100 | 100 | — | — | 14 | 6.58 | 0.54 | B |
| Comparative Example 2 | 100 | 100 | Carbon black | 5 | 16 | 10.53 | 0.58 | B |
| Comparative Example 3 | 100 | 100 | Carbon black | 10 | 38 | 20.72 | 0.68 | A |

3. Evaluation of pressure roller

A pore diameter of the elastic layer was 18 μm (with a standard deviation of 7.33), and a specific gravity of the elastic layer was 0.56. In addition, the result of the image evaluation was A rank. The evaluation result is shown in Table 1. Meanwhile, details of the electrically conductive agent used in each of Examples and Comparative Examples are shown in Table 2.

Examples 2 to 5

A liquid silicone rubber composition was obtained in the same manner as Example 1 except that each of ionic conductive agents was changed to a compound shown in Table 1. Then, each of pressure rollers No. 2 to No. 5 was obtained. The evaluation result is shown in Table 1.

TABLE 2

| Electrically conductive agent | Product name |
|---|---|
| $CF_3SO_3K$ | "EF-12", manufactured by Mitsubishi Materials Electronic Chemicals Co., Ltd. |
| $CF_3SO_3Li$ | "EF-15", manufactured by Mitsubishi Materials Electronic Chemicals Co., Ltd. |
| $(CF_3SO_2)_2NK$ | "EF-N112", manufactured by Mitsubishi Materials Electronic Chemicals Co., Ltd. |
| $(CF_3SO_2)_2NLi$ | "EF-N115", manufactured by Mitsubishi Materials Electronic Chemicals Co., Ltd. |
| $C_4F_9SO_3Li$ | "EF-45", manufactured by Mitsubishi Materials Electronic Chemicals Co., Ltd. |
| Carbon black | "EC600JD", manufactured by Lion Specialty Chemicals Co., Ltd. |

[Consideration]

In Comparative Example 1, the electrostatic offset image was generated since the elastic layer of the pressure roller was not compounded with any electrically conductive agent. In addition, in Comparative Example 2, though the elastic layer was compounded with carbon black as the electrically conductive agent, it was not sufficient to suppress the generation of the electrostatic offset image. In Comparative Example 3, the electrostatic offset image was not generated because the compounded amount of carbon black was increased compared with Comparative Example 2, but the specific gravity was high. When the specific gravity is high, an effect for reducing a rise time of the fixing apparatus becomes low.

On the contrary, in Example 1 to Example 5, occurrence of the electrostatic offset image was suppressed. Further, the pore diameter and the specific gravity were on the same level as those of Comparative Example 1. Accordingly, performances were capable of being maintained at the same level as those observed in the case where the elastic layer was not compounded with any electrically conductive agent, from the points of view of quality and strength of an image, and an effect for reducing a rise time.

As described above, in the pressure roller according to the present invention, an electrically conductive path is formed by an ionic conductive agent remaining in a communication hole, and electrical conductivity is given to an elastic layer. This is because water which is emulsified and dispersed into a liquid silicone rubber, which is the raw material of the elastic layer, contains the water-soluble ionic conductive agent and water evaporates such that the communication hole is formed. The communication hole in which fine and uniform pores are communicated is maintained, and it is possible to establish both improvement of quality and strength of an image and suppression of a rise time and an electrostatic offset, since no trouble such as a reduced effect of an emulsifier is caused by compounding a silicone rubber with an electrically conductive agent.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-010531, filed Jan. 24, 2017, which is hereby incorporated by reference herein in its entirety.

What is claimed is:

1. An electrophotographic member comprising a substrate, an elastic layer, and a surface layer in this order, wherein the surface layer contains a fluororesin, and the elastic layer has a communication hole of which pores are communicated with each other, and an ionic conductive agent is adhered to an inner wall of the communication hole.

2. The electrophotographic member according to claim 1, wherein an average diameter of the pores is 5 to 30 μm.

3. The electrophotographic member according to claim 1, wherein the ionic conductive agent is at least one of a potassium salt type ionic conductive agent and a lithium salt type ionic conductive agent.

4. The electrophotographic member according to claim 1, wherein the elastic layer contains a silicone rubber.

5. A method for manufacturing an electrophotographic member, the method comprising:

arranging a fluororesin layer at an outer periphery of a substrate separately from the substrate and injecting a liquid silicone rubber composition into a space between the substrate and the fluororesin layer, the liquid silicone rubber composition containing a liquid silicone rubber into which water, in which an ionic conductive agent is dissolved, is emulsified and dispersed;

primarily curing the liquid silicone rubber composition to form a silicone rubber layer in a water-containing state; and removing water from the silicone rubber layer in the water-containing state to form an elastic layer having a communication hole of which pores are communicated with each other, wherein the ionic conducting agent is adhered to an inner wall of the communication hole.

6. The method for manufacturing the electrophotographic member according to claim 5, wherein the liquid silicone rubber composition is a mixture of a water-containing gel that contains water in which the ionic conductive agent is dissolved beforehand and the liquid silicone rubber that is compounded with an emulsifier.

7. The method for manufacturing the electrophotographic member according to claim 5, wherein the step of injecting the liquid silicone rubber composition into the space between the substrate and the fluororesin layer comprises arranging a fluororesin tube on an inner wall surface of a cylindrical die, arranging the substrate within the cylindrical die concentrically by inserting a die mold that holds the substrate and has an inlet port into one end part of the cylindrical die and by inserting a die mold that has an outlet port into the other end part of the cylindrical die, and injecting the liquid silicone rubber composition from the inlet port into a gap between the substrate and the fluororesin tube within the cylindrical die;

the primarily curing is performed by a heat treatment of the cylindrical die at a temperature below the boiling point of water in a state where the inlet port and the outlet port are closed; and the removal of water from the silicone rubber layer in the water-containing state is performed by a heat treatment of the cylindrical die at a temperature equal to or above the boiling point of water in a state where the die molds are removed from both end parts of the cylindrical die.

8. The method for manufacturing the electrophotographic member according to claim 5, wherein the ionic conductive agent is at least one of a potassium salt type ionic conductive agent and a lithium salt type ionic conductive agent.

9. A fixing apparatus comprising a fixing member, and a nip portion forming member that fixes an unfixed toner image as a fixed image on a recording material by causing elastic deformation by being pressure-contacted with the fixing member to form a fixing nip part that sandwiches, conveys and heats the recording material on which the unfixed toner image is formed, wherein the nip portion forming member is an electrophotographic member comprising a substrate, an elastic layer, and a surface layer in this order, the surface layer contains a fluororesin, and the elastic layer has a communication hole of which pores are communicated with each other, and an ionic conductive agent is adhered to an inner wall of the communication hole.

10. The electrophotographic member according to claim 1, wherein a clay mineral is further adhered to the inner wall of the communication hole.

* * * * *